US007244289B2

(12) United States Patent
Su

(10) Patent No.: US 7,244,289 B2
(45) Date of Patent: Jul. 17, 2007

(54) AIR PURIFIER WITH DETACHABLE IONIZER UNIT

(76) Inventor: Zhi Xiang Su, Huangchong Industrial Park, Huangchong Village, Beijiao, Shunde, Foshan, Guangdong (CN)

( * ) Notice: Subject to any disclaimer, the term of this patent is extended or adjusted under 35 U.S.C. 154(b) by 0 days.

(21) Appl. No.: 11/487,285

(22) Filed: Jul. 14, 2006

(65) Prior Publication Data

US 2007/0014072 A1 Jan. 18, 2007

Related U.S. Application Data

(60) Provisional application No. 60/700,476, filed on Jul. 18, 2005.

(51) Int. Cl.
*B03C 3/74* (2006.01)

(52) U.S. Cl. ..... 96/39; 96/40; 96/51; 96/86; 96/96; 422/186.04; 422/186.13

(58) Field of Classification Search ..... 96/29, 96/39–41, 51, 83–87, 94, 96; 95/74–76; 422/186.04, 186.13
See application file for complete search history.

(56) References Cited

U.S. PATENT DOCUMENTS 3,173,774 A * 3/1965 Getzin ..... 96/86
4,284,420 A * 8/1981 Borysiak ..... 96/40
5,071,455 A * 12/1991 Abedi-Asl ..... 96/80
6,749,667 B2 * 6/2004 Reeves et al. ..... 95/76
6,855,190 B1 * 2/2005 Nikkhah ..... 96/51
6,908,501 B2 * 6/2005 Reeves et al. ..... 96/29
7,077,890 B2 * 7/2006 Botvinnik ..... 96/69
2005/0051028 A1 * 3/2005 Botvinnik ..... 96/88
2005/0051420 A1 * 3/2005 Botvinnik et al. ..... 204/164
2006/0021509 A1 * 2/2006 Taylor et al. ..... 96/83
2006/0180027 A1 * 8/2006 McDonnell et al. ..... 96/40

FOREIGN PATENT DOCUMENTS

JP 4-200756 A * 7/1992 ..... 96/84

* cited by examiner

*Primary Examiner*—Richard L. Chiesa
(74) *Attorney, Agent, or Firm*—Raymond Y. Chan; David and Raymond Patent Group

(57) ABSTRACT

An air purifier includes an outer casing and an ionizer module. The outer casing has a top portion, a bottom portion having an electrode opening, an air purifying cavity defining between the top and bottom portion, and a peripheral opening communicating with the air purifying cavity. The ionizer module includes a power unit and an ionizing electrode unit. The ionizing electrode unit is detachably slid into the air purifying cavity through the electrode opening of the bottom portion of the outer casing, wherein the ionizing electrode unit has a top terminal end arranged to electrically contact with the power unit to ionize the ambient air for emitting ozone thereto when the ambient air is circulated through the peripheral opening along the ionizing electrode unit.

20 Claims, 4 Drawing Sheets

AIR PURIFIER WITH DETACHABLE IONIZER UNIT

CROSS-REFERENCE TO RELATED APPLICATION

This is a non-provisional application of a provisional application having an application No. 60/700,476 and a filing date of Jul. 18, 2005.

BACKGROUND OF THE PRESENT INVENTION

1. Field of Invention

The present invention relates to a purifier, and more particularly to an air purifier which produces a desirable level of ozone emission into the ambient air so as to maintain desirable air quality for a user of the present invention.

2. Description of Related Arts

Air purifiers have widely been utilized all over the world for providing extra ozone emission to ambient air in indoors environment. For example, one may put an air purifier in his/her living room for enhancing the air quality therewithin.

A conventional air purifier typically comprises an outer casing and an ionizer module supported in the outer casing for ionizing ambient air and releasing a predetermined level of ozone to the ambient air in which the air purifier is operating. The ionizer module usually comprises a plurality of ionizing electrodes electrically connected to a power supply for conducting electricity so as to generate electricity field for ionizing the ambient air which passes through the ionizing electrodes. For this kind of conventional air purifier, the ionizer module is usually detachable from a top surface of the outer casing so that the user is able to clean the ionizer module periodically for ensuring proper working thereof. Accordingly, the outer casing usually has a through top opening provided on a top surface thereof wherein the user is able to put the ionizer module into the outer casing via the top opening.

There are several disadvantages in association with this kind of conventional air purifier. First, every time the user has cleaned the ionizer module, he/she has to insert it through the top opening in order for the ionizer module to electrically contact with the power supply. In many occasions, the air purifier may be specifically designed that the ionizer module should freely fall within the outer casing from the top opening so as to contact with the power supply supported at a bottom portion of the outer casing. The problem here is that the ionizer module, which is usually embodied as a plurality of metal-made electrodes, is heavy, so that when the ionizer module is left freely falling within the outer casing, the impact which it may induce to the power supply may be such that any electrical terminals or electronics devices connecting between the ionizer module and the power supply would be gradually damaged. As a result, the overall life span of the air purifier as a whole may be substantially shortened by this disadvantage.

Second, because the ionizing module is freely falling within the outer casing for electrically contacting with the power supply, as a result, there is a high chance that ionizing module and the power supply is misaligned so that proper electrical connection between the ionizing module and the power supply may not be achieved. Consequently, the air purifier may not work properly and produce unsatisfactory performance.

SUMMARY OF THE PRESENT INVENTION

A main object of the present invention is to provide an air purifier which is capable of emitting a desirable level of ozone to the ambient air in which it operates so as to maintain a desirable air quality of the ambient air.

Another object of the present invention is to provide an air purifier which comprises an outer casing and an ionizing module, wherein the ionizing module is slidably inserted into the outer casing at a bottom portion thereof so as to avoid the above-mentioned disadvantages associated with conventional air purifiers, viz. free falling ionizing module which may damage the electrical terminals and lead to misalignment between the power supply and the ionizing module.

Another object of the present invention is to provide an air purifier wherein a power unit is supported at a bottom portion of the outer casing so as to ensure that a center of gravity of the entire air purifier is such that a maximum stability of the present invention can be maintained.

Another object of the present invention is to provide an air purifier which does not involve complicated mechanical and electrical arrangement so as to minimize the manufacturing cost and the same time promote widespread application of the present invention.

Accordingly, in order to accomplish the above objects, the present invention provides an air purifier, comprising:

an outer casing having a top portion, a bottom portion having an electrode opening, an air purifying cavity defining between the top and bottom portion, and a peripheral opening communicating with the air purifying cavity; and an ionizer module, which comprises:

a power unit supported at the outer casing, wherein the power unit comprises an electrode terminal extended downwardly; and an ionizing electrode unit which comprises a detachable electrode blade detachably slid into the air purifying cavity through the electrode opening of said bottom portion of the outer casing, wherein the detachable electrode blade has a top terminal end arranged to electrically contact with the electrode terminal of the power unit to ionize the ambient air in a vicinity of the detachable electrode blade, such that the ionizing electrode unit is adapted for generating an optimal level of ozone emission to the ambient air which is circulated through the peripheral opening along the ionizing electrode unit.

These and other objectives, features, and advantages of the present invention will become apparent from the following detailed description, the accompanying drawings, and the appended claims.

DETAILED DESCRIPTION OF THE PREFERRED EMBODIMENT

Figure 1:
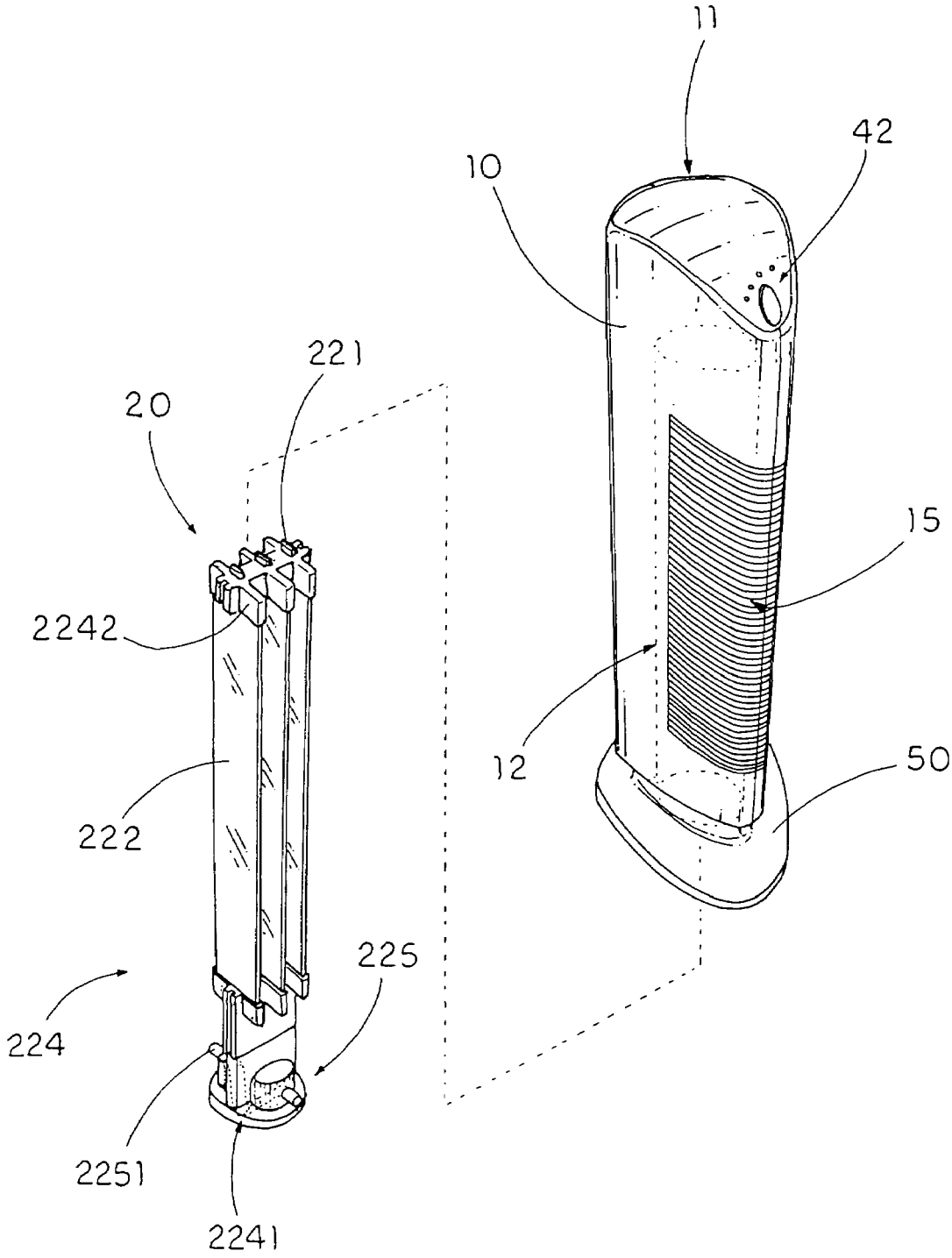
FIG. 1 is an exploded perspective view of an air purifier according to a preferred embodiment of the present invention.

Referring to FIG. 1 to FIG. 4 of the drawings, an air purifier according to a preferred embodiment of the present invention is illustrated, in which the air purifier comprises an outer casing 10 and an ionizer module 20.

The outer casing 10 has a top portion 11, a bottom portion 12 having an electrode opening 13, an air purifying cavity 14 defining between the top and bottom portion 11, 12, and a peripheral opening 15 communicating with the air purifying cavity 14.

The ionizer module 20 is supported by the outer casing 10 and comprises a power unit 21, and an ionizing electrode unit 22. The power unit 21 is supported at the outer casing 10, wherein the power unit 21 comprises an electrode terminal 211 downwardly extended within the air purifying cavity 14.

On the other hand, the ionizing electrode unit 22, which comprises a detachable electrode blade 222, is detachably slid into the air purifying cavity 14 through the electrode opening 13 of the bottom portion 12 of the outer casing 10, wherein the ionizing electrode unit 22 has a top terminal end 221 formed on the detachable electrode blade 222 and arranged to electrically contact with the electrode terminal 211 of the power unit 21 to ionize the ambient air in a vicinity of the detachable electrode blade 222, such that the ionizing electrode unit 22 is adapted for generating an optimal level of ozone emission to the ambient air which is circulated through the peripheral opening 15 along the ionizing electrode unit 22.

According to the preferred embodiment, the outer casing 10 is elongated in shape having a substantially triangular cross section to form the top portion 11, the bottom portion 12 and the air purifying cavity 14. The electrode opening 13 is formed on a bottom surface of the outer casing 10 for the ionizer module 20 to be inserted into the air purifying cavity 14 through the electrode opening 13. Moreover, the outer casing 10 preferably has a plurality of peripheral openings 15 which are preferably embodied as a plurality of through ventilating slits formed on the sidewalls of the outer casing 10 for communicating the air purifying cavity 14 with an exterior of the outer casing 10. In other words, ambient air is allowed to circulate within the air purifying cavity 14 through the peripheral opening 15 wherein the ambient air is emitted an optimal level of ozone by the ionizer module 20.

The ionizing electrode unit 22 comprises a plurality of detachable electrode blades 222 longitudinally extended and alignedly supported within the air purifying cavity 14, and a plurality of electrode wires 223 longitudinally extended within the air purifying cavity 14 at a position spacedly apart from the detachable electrode blades 222 for creating an ionizing zone between the detachable electrode blades 222 and the electrode wires 223 within the air purifying cavity 14. The detachable electrode blades 222 and the electrode wires 223 are arranged to electrically connect with the power unit 21 and be coupled in series between the electrode terminals 211 when the ionizing electrode unit 22 is slidably received into the air purifying cavity 14.

Figure 2:
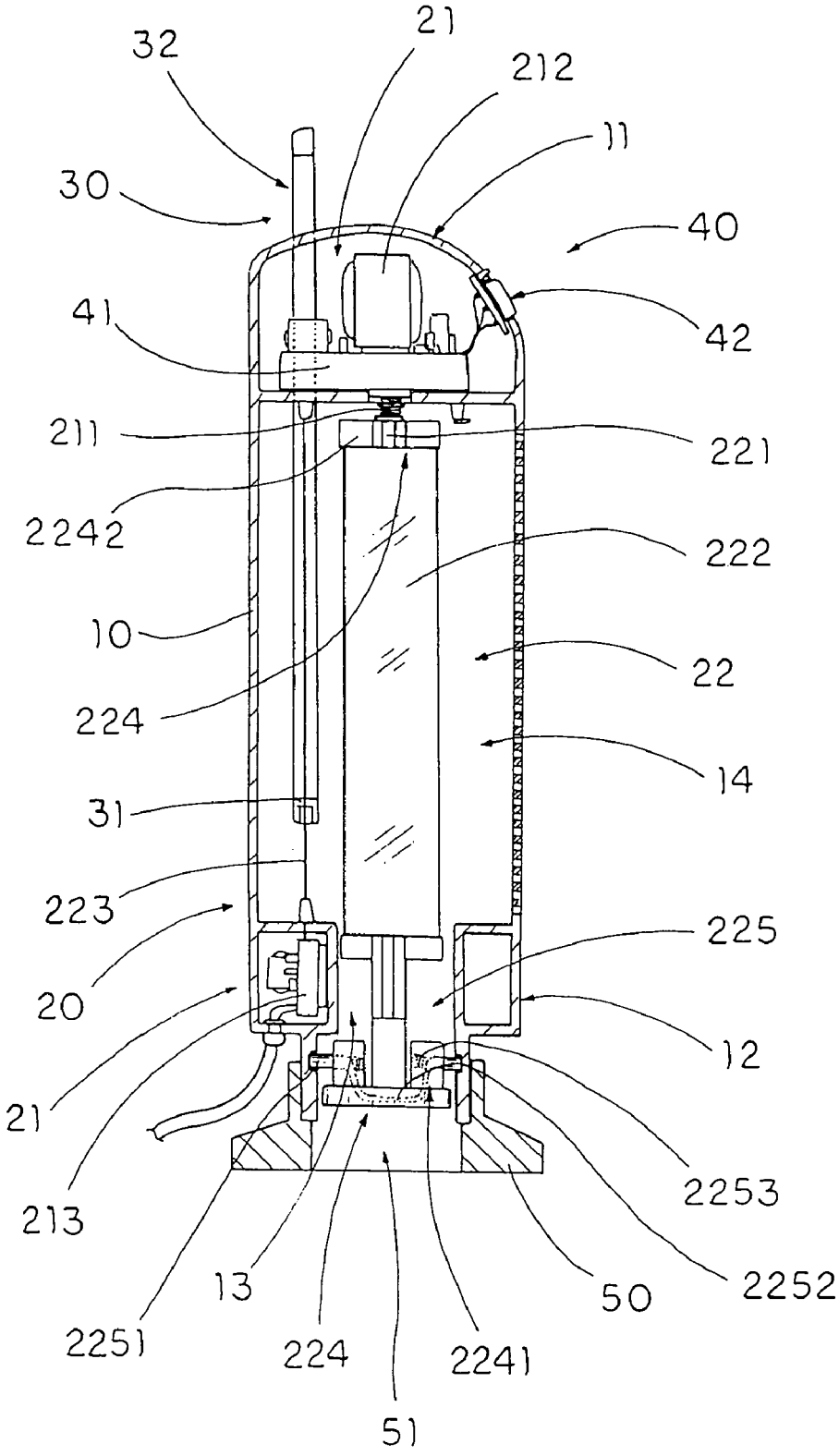
FIG. 2 is a sectional side view of the air purifier according to the above preferred embodiment of the present invention.
Figure 3:
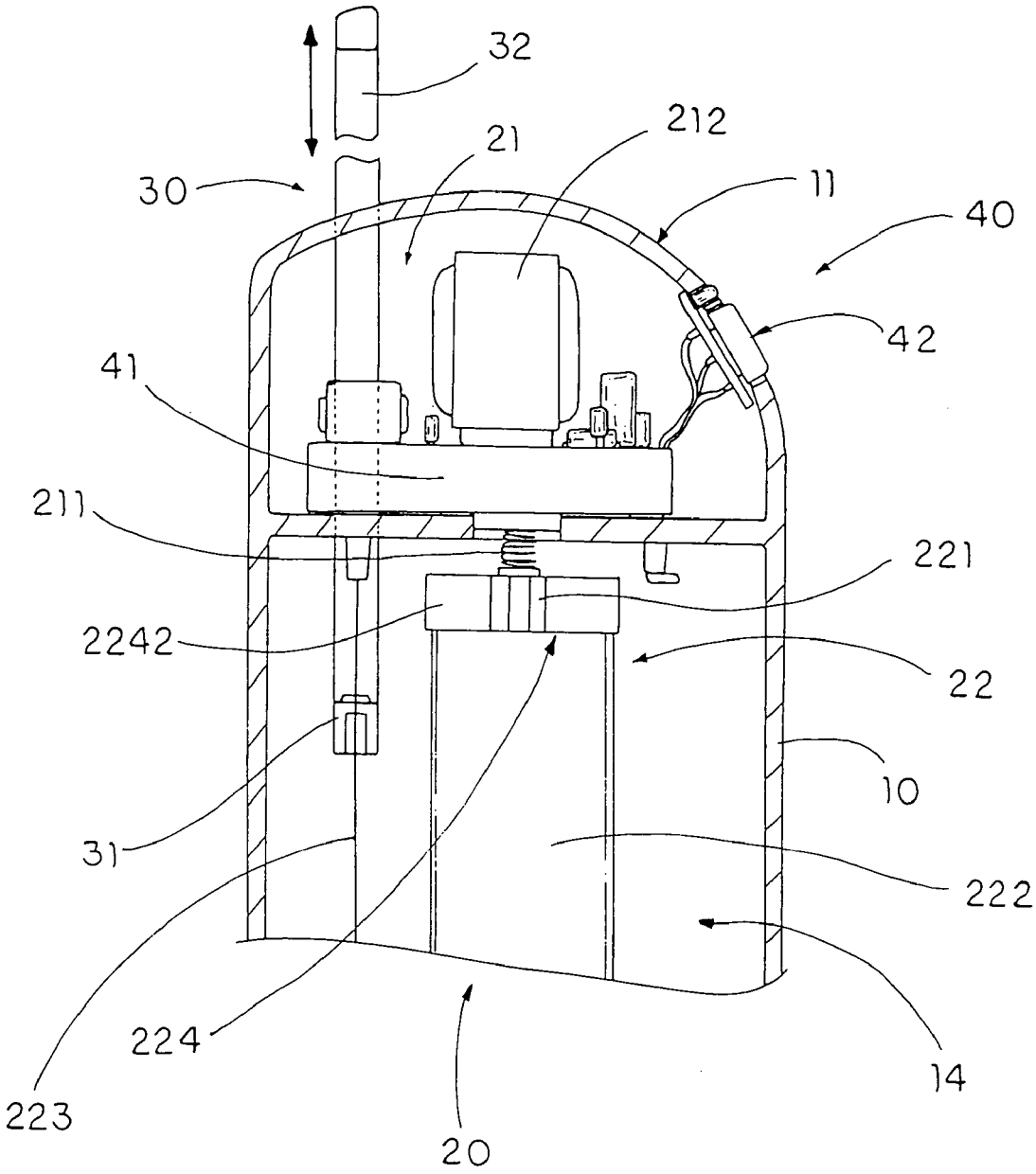
FIG. 3 is a partially sectional side view of the air purifier according to the above preferred embodiment of the present invention.
Figure 4:
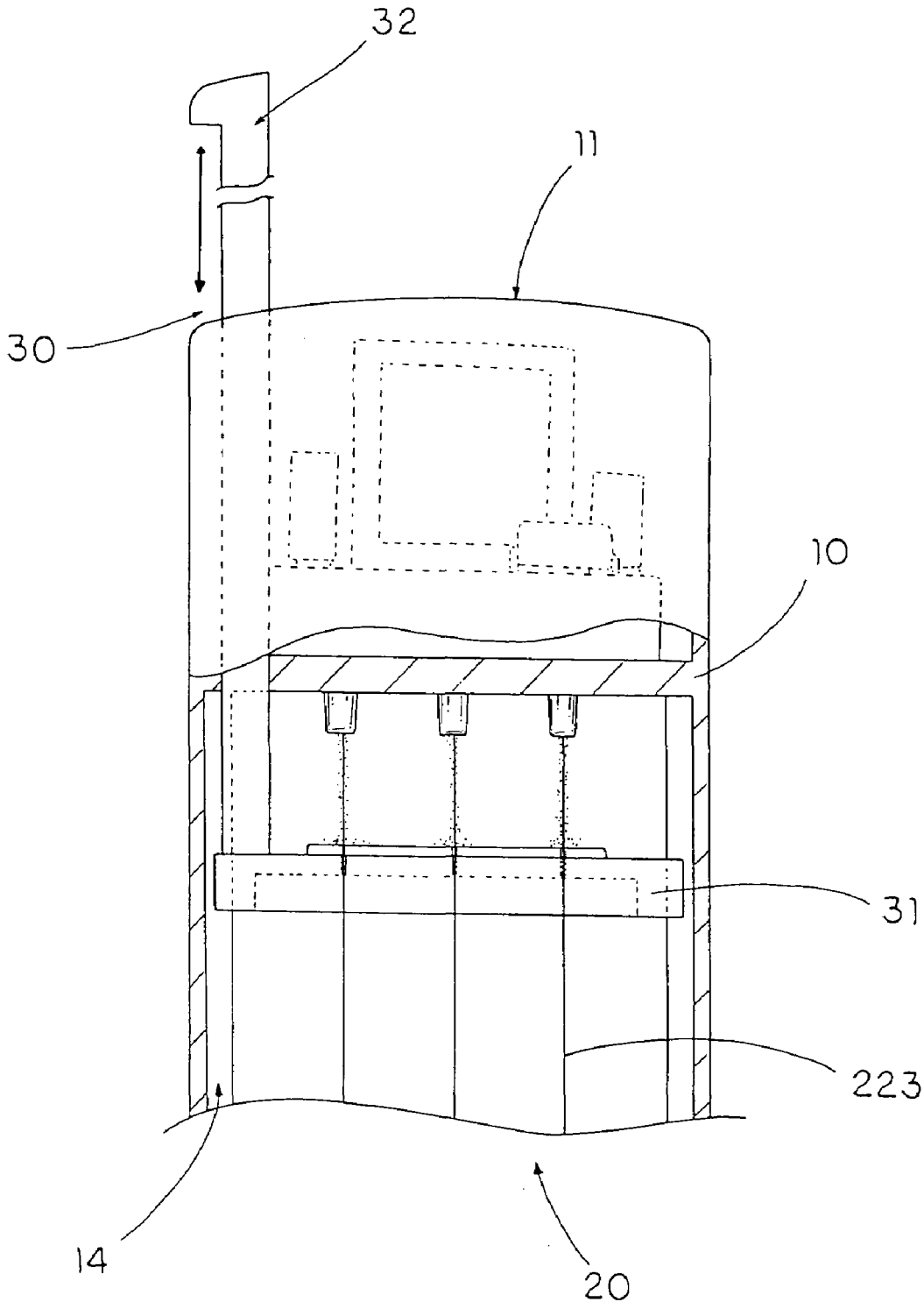
FIG. 4 is a schematic diagram of the air purifier according to the above preferred embodiment of the present invention.

In order to facilitate easy operation of the present invention, the ionizing electrode unit 22 further comprises a blades holder 224 which couples with and supports the detachable electrode blades 222 in a spacedly apart manner for aligning with the electrode terminals 211 of the power unit 21 when the detachable electrode blades 222 are slidably inserted into the air purifying cavity 14. Referring to FIG. 1 and FIG. 2 of the drawings, the blades holder 224 has a gripping end 2241 extended at the bottom portion 12 of the outer casing 10 so that a user is able to hold on the gripping end 2241 for collectively sliding the detachable electrode blades 222 in or out of the air purifying cavity 14.

It is worth mentioning that the user of the present invention is only allowed to slide the detachable electrode blades 222 into or out of the air purifying cavity 14 via the electrode opening 13 provided at the bottom portion 12 of the outer casing 10. Therefore, the sliding motion of the detachable electrode blades 222 is accomplished by controlled sliding force provided by the user, so that the disadvantages mentioned for the conventional air purifiers (namely uncontrolled free falling of the ionizing module) are effectively avoided.

Moreover, the blade holder 224 further comprises a terminal end holder 2242 mounted at the top terminal end 221 of the detachable electrode blades 222 for holding the top terminal end 221 of the detachable electrode blades 222 in position for aligning with the electrode terminal 211 of the power unit 21. In other words, the top terminal end 221 is substantially held by the terminal end holder 2242 for ensuring proper alignment between the top terminal end 221 and the electrode terminal 211. The terminal end holder 2242 and the electrode opening 13 have substantially the same cross sectional shape so that the terminal end holder 2242 is capable of fittedly passing through the electrode opening 13.

According to the preferred embodiment of the present invention, the blade holder 224 further comprises a locking arrangement 225 for normally retaining the detachable electrode blade 222 within the air purifying cavity 14 so that the detachable electrode blade 222 is capable of substantially contacting with the electrode terminal 211 of the power unit 21 even when the outer casing 10 is standing on a ground surface (in which case the detachable electrode blade 222 tends to fall downwardly as a result of gravitational force exerted thereon).

Preferably, the locking arrangement 225 comprises a locking latch 2251 movably supported between the blade holder 224 and the outer casing 10, and a releasing button 2252 provided on the blade holder 224 for actuating the locking latch 2251 to move between a locking position and an unlocking position, wherein in the locking position, the locking latch 2251 is transversely extended at the outer casing 10 to block a downward movement of the blade holder 224, and in the unlocking position, the locking latch 2251 is moved to detach from the outer casing 10 so as to allow the blade holder 224 (so as the detachable electrode blades 222) to slide freely along the air purifying cavity 14 via the electrode opening 13. In other words, the detachable electrode blades 222 are now capable of being slid out of the air purifying cavity 14 via the electrode opening 13 at the bottom portion 12 of the outer casing 10.

The locking arrangement 225 further comprises a resilient element 2253 mounted at the blade holder 224 for normally exerting an urging force to retain the locking latch 2251 at the locking position. In other words, the user is able to press the releasing button 2252 so as to move the locking latch 2251 to move from the locking position to the unlocking position for sliding the detachable electrode blades 222 out of the air purifying cavity 14.

In order to further facilitate easy detachment of the detachable electrode blades 222, the electrode terminal 211 of the power unit 21 is preferably embodied as having a predetermined amount of resilient ability so that when the detachable electrode blades 222 are received and properly locked in the air purifying cavity 14, the electrode terminal 211 is compressed while conducting electricity from the power unit 21 to the ionizing electrode unit 22. As a result, when the locking arrangement 225 is unlocked, the electrode terminal 221 is released of the compression force and tends to push the detachable electrode blades 222 out of the air purifying cavity 14.

The power unit 21 is preferably embodied as comprising a high-voltage generating unit 212 which is adapted to apply a predetermined level of potential difference between the ionizing electrode unit 22 (the detachable electrode blades 222 and the electrode wires 223) so as to create the attracting force between the detachable electrode blades 222 and the electrode wires 223 for ionizing the ambient air in the air purifying cavity 14. Moreover, the power unit 21 further comprises a power circuitry 213 for processing externally gathered power supply so as to convert AC voltage to DC voltage. The principle is as follows: when a high potential difference between the detachable electrode blades 222 and the electrode wires 223 are applied, an electric field is generated in the vicinity of these electrodes 222, 223. As a result, the ambient air surrounding these electrodes 222, 223 is ionized and air circulation is created within the air purifying cavity 14 through ventilation at the peripheral opening 15.

Consequently, during the course of ions flow between the detachable electrode blades 222 and the electrode wires 223, air molecules are subject to momentum transfers created by the ions flows so that air molecules are pushed towards the detachable electrode blades 222 while ozone is generated in the ambient air which is capable of beneficially destroying or removing bacteria, germs, odors or any other relevant unwanted materials.

In order to ensure satisfactory working condition of the present invention, the air purifier further comprises an elongated cleaning member 30 slidably mounted on the outer casing 10, wherein the elongated cleaning member 30 has a cleaning head 31 provided within the air purifying cavity 14 at a position slidably contacting with the electrode wires 223, and a handle end portion 32 longitudinally extended out of the air purifying cavity 14 for normally resting on the top portion 11 of the outer casing 10. Accordingly, the elongated cleaning member 30 is adapted to slide with respect to the outer casing 10 so that the cleaning head 31 is arranged to slide along the electrode wires 223 so as to remove any unwanted ionizing residuals or dirt particles sticking or attaching in the electrode wires 223. In other words, with the elongated cleaning member 30, the electrode wires 223 can be kept to the optimal condition for effective ionization of the ambient air so as to effectively control an optimal emission of ozone to the ambient air.

Referring to FIG. 1 and FIG. 2 of the drawings, the air purifier further comprises a control module 40 comprising a control circuitry 41 mounted in the outer casing 10 and electrically connected with the power unit 21 for controlling an operation thereof, and a control panel 42 provided on the top portion 11 of the outer casing 10 and electrically connected with the control circuitry 41 for allowing a user to control an operation of the entire air purifier. Thus, a user is able to conveniently operate the present invention by pressing buttons on the control panel 42.

According to the preferred embodiment of the present invention, the air purifier further comprises a standing base 50 detachably mounted at the bottom portion 12 of the outer casing 10 for substantially supporting the outer casing 10. As a result, the standing base 50 has an access opening 51 aligning with the electrode opening 13 of the bottom portion 12 of the outer casing 10 wherein the detachable electrode blades 222 are capable of sliding in or out of the air purifier cavity 14 through the electrode opening 13 and the access opening 51.

From the forgoing descriptions, the figures show that the high-voltage generating unit 212 is supported at a top portion 11 of the outer casing 10, but it is important to realize that the power unit 21 (particularly the high-voltage generating unit 212) may be supported at the bottom portion 12 of the outer casing 10 so that a distance between the center of gravity of the entire air purifier and the ground surface can be minimized for achieving maximum stability of the present invention. Moreover, the supporting stand 50 may be rotatably mounted at the bottom portion 12 of the outer casing 10 so that the low center of gravity of the present invention may help to stabilize the rotational movement of the outer casing 10 with respect to the standing base 50.

From the forgoing descriptions, it can be shown that the above-mentioned objects have been substantially accomplished. The present invention provides an air purifier which is capable of emitting a desirable level of ozone to the ambient air in which it operates so as to maintain a desirable air quality of the ambient air. The detachable electrode blades 222 can be slidably inserted into or out of the air purifier cavity 14 via the electrode opening 13 at the bottom portion 12 of the outer casing 10 so as to substantially overcome the disadvantages of the conventional air purifiers.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An air purifier, comprising:

an outer casing having a top portion, a bottom portion having an electrode opening, an air purifying cavity defining between said top and bottom portions, and a peripheral opening communicating with said air purifying cavity; and an ionizer module, which comprises:

a power unit supported within said top portion of said outer casing, wherein said power unit comprises an electrode terminal extended downwardly;

a plurality of electrode wires longitudinally extended within said air purifying cavity to electrically connect to said power unit; and an ionizing electrode unit, which is detachably mounted to said outer casing, comprising a plurality of detachable electrode blades spacedly and upwardly slid into said air purifying cavity through said electrode opening of said bottom portion of said outer casing for minimizing a weight of said ionizing electrode unit applying at said electrode terminal, wherein said electrode wires are supported within said air purifying cavity at a position aligning with said detachable electrode blades, wherein each of said detachable electrode blades has a top terminal end arranged to electrically contact with said electrode terminal of said power unit for ionizing an ambient air in a vicinity of said detachable electrode blades, such that said ionizing electrode unit is adapted for generating an optimal level of ozone emission to said ambient air to form an air flow passing out of said outer casing through said peripheral opening.

2. The air purifier, as recited in claim 1, wherein said ionizing electrode unit further comprises a locking arrangement for locking said detachable electrode blades within said air purifying cavity to retain said detachable electrode blades in contact with said electrode terminal, wherein said locking arrangement comprises a locking latch movably and outwardly extended from a bottom portion of said ionizing electrode unit and a releasing button operatively actuating said locking latch to move between a locking position and an unlocking position, wherein at said locking position, said locking latch is transversely extended at said outer casing to block a downward movement of said ionizing electrode unit, and at said unlocking position, said locking latch is moved to detach from said outer casing to allow said ionizing electrode unit to downwardly slide along said air purifying cavity through said electrode opening so as to detach said ionizing electrode unit from said outer casing.

3. The air purifier, as recited in claim 2, wherein said locking arrangement further comprises a resilient element supported at said bottom portion of said ionizing electrode unit for normally exerting an urging force against said locking latch to retain said locking latch at said locking position.

4. The air purifier, as recited in claim 1, wherein said electrode terminal is made of resilient material to ensure said detachable electrode blades are in contact with said electrode terminal.

5. The air purifier, as recited in claim 2, wherein said electrode terminal is made of resilient material to ensure said detachable electrode blades are in contact with said electrode terminal.

6. The air purifier, as recited in claim 3, wherein said electrode terminal is made of resilient material to ensure said detachable electrode blades are in contact with said electrode terminal.

7. The air purifier, as recited in claim 1, wherein said ionizing electrode unit further comprises a blade holder which couples with and spacedly supports the detachable electrode blades for aligning with said electrode terminals of said power unit when said detachable electrode blades are slidably and upwardly inserted into said air purifying cavity, wherein said blade holder has a gripping end extended at said bottom portion of said outer casing for allowing said ionizing electrode unit being controllably slid in or out of said air purifying cavity.

8. The air purifier, as recited in claim 3, wherein said ionizing electrode unit further comprises a blade holder which couples with and spacedly supports the detachable electrode blades for aligning with said electrode terminals of said power unit when said detachable electrode blades are slidably and upwardly inserted into said air purifying cavity, wherein said blade holder has a gripping end extended at said bottom portion of said outer casing for allowing said ionizing electrode unit being controllably slid in or out of said air purifying cavity.

9. The air purifier, as recited in claim 6, wherein said ionizing electrode unit further comprises a blade holder which couples with and spacedly supports the detachable electrode blades for aligning with said electrode terminals of said power unit when said detachable electrode blades are slidably and upwardly inserted into said air purifying cavity, wherein said blade holder has a gripping end extended at said bottom portion of said outer casing for allowing said ionizing electrode unit being controllably slid in or out of said air purifying cavity.

10. The air purifier, as recited in claim 8, wherein said locking arrangement is provided at said blade holder.

11. The air purifier, as recited in claim 9, wherein said locking arrangement is provided at said blade holder.

12. The air purifier, as recited in claim 7, wherein said blade holder further comprises a terminal end holder mounted at said top terminal ends of said detachable electrode blades for holding said top terminal end of said detachable electrode blades in position so as to align with said electrode terminal of said power unit, such that said top terminal end is substantially held by said terminal end holder for ensuring proper alignment between said top terminal end and said electrode terminal.

13. The air purifier, as recited in claim 9, wherein said blade holder further comprises a terminal end holder mounted at said top terminal ends of said detachable electrode blades for holding said top terminal end of said detachable electrode blades in position so as to align with said electrode terminal of said power unit, such that said top terminal end is substantially held by said terminal end holder for ensuring proper alignment between said top terminal end and said electrode terminal.

14. The air purifier, as recited in claim 11, wherein said blade holder further comprises a terminal end holder mounted at said top terminal ends of said detachable electrode blades for holding said top terminal end of said detachable electrode blades in position so as to align with said electrode terminal of said power unit, such that said top terminal end is substantially held by said terminal end holder for ensuring proper alignment between said top terminal end and said electrode terminal.

15. The air purifier, as recited in claim 1, further comprising an elongated cleaning member slidably mounted on said outer casing, wherein said elongated cleaning member has a cleaning head provided within said air purifying cavity at a position slidably contacting with said electrode wires and a handle end portion longitudinally extended out of said air purifying cavity for normally resting on said top portion of said outer casing, such that when said elongated cleaning member is slid with respect to said outer casing, said cleaning head is driven to slide along said electrode wires for removing any unwanted ionizing residuals attaching along said electrode wires.

16. The air purifier, as recited in claim 6, further comprising an elongated cleaning member slidably mounted on said outer casing, wherein said elongated cleaning member has a cleaning head provided within said air purifying cavity at a position slidably contacting with said electrode wires and a handle end portion longitudinally extended out of said air purifying cavity for normally resting on said top portion of said outer casing, such that when said elongated cleaning member is slid with respect to said outer casing, said cleaning head is driven to slide along said electrode wires for removing any unwanted ionizing residuals attaching along said electrode wires.

17. The air purifier, as recited in claim 14, further comprising an elongated cleaning member slidably mounted on said outer casing, wherein said elongated cleaning member has a cleaning head provided within said air purifying cavity at a position slidably contacting with said electrode wires and a handle end portion longitudinally extended out of said air purifying cavity for normally resting on said top portion of said outer casing, such that when said elongated cleaning member is slid with respect to said outer casing, said cleaning head is driven to slide along said electrode wires for removing any unwanted ionizing residuals attaching along said electrode wires.

18. The air purifier, as recited in claim 6, further comprising a standing base detachably mounted at said bottom portion of said outer casing for substantially supporting said outer casing in an upright manner, wherein said standing base has an access opening aligning with said electrode opening of said outer casing at said bottom portion thereof, such that said detachable electrode blades are slid in or out of said air purifying cavity through said electrode opening and said access opening.

19. The air purifier, as recited in claim 14, further comprising a standing base detachably mounted at said bottom portion of said outer casing for substantially supporting said outer casing in an upright manner, wherein said standing base has an access opening aligning with said electrode opening of said outer casing at said bottom portion thereof, such that said detachable electrode blades are slid in or out of said air purifying cavity through said electrode opening and said access opening.

20. The air purifier, as recited in claim 17, further comprising a standing base detachably mounted at said bottom portion of said outer casing for substantially supporting said outer casing in an upright manner, wherein said standing base has an access opening aligning with said electrode opening of said outer casing at said bottom portion thereof, such that said detachable electrode blades are slid in or out of said air purifying cavity through said electrode opening and said access opening.

* * * * *